US007435313B2

(12) United States Patent
Boatman et al.

(10) Patent No.: US 7,435,313 B2
(45) **Date of Patent: *Oct. 14, 2008**

(54) PROCESS FOR PRODUCING DEEP-NESTED EMBOSSED PAPER PRODUCTS

(75) Inventors: Donn Nathan Boatman, Union, KY (US); Kevin Benson McNeil, Loveland, OH (US); Matthew Alan Russell, Middletown, OH (US); George Vincent Wegele, Mason, OH (US); Kevin Mitchell Wiwi, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 610 days.

This patent is subject to a terminal disclaimer.

(21) Appl. No.: 11/130,876

(22) Filed: May 17, 2005

(65) Prior Publication Data

US 2005/0257910 A1 Nov. 24, 2005

Related U.S. Application Data

(60) Provisional application No. 60/573,727, filed on May 21, 2004.

(51) Int. Cl.
*D21H 27/30* (2006.01)
*B31F 1/07* (2006.01)
*D21F 11/00* (2006.01)

(52) U.S. Cl. ..... 162/117; 162/123; 162/132; 162/204; 162/205; 162/362; 156/209; 428/156; 428/172

(58) Field of Classification Search ..... 162/109, 162/117, 123, 132, 205–207, 361, 362; 156/209; 428/156, 174, 152–154, 172; 101/3.1, 22, 101/23, 32; 425/384, 385, 394, 395, 403, 425/403.1, 404, 406–408; 264/119, 258, 264/284, 293

See application file for complete search history.

(56) References Cited

U.S. PATENT DOCUMENTS 1,863,973 A 6/1932 Ellis, Jr.

(Continued)

FOREIGN PATENT DOCUMENTS

DE 18 07 842 A1 7/1969

(Continued)

OTHER PUBLICATIONS

PCT International Search Report mailed Oct. 10, 2005.

*Primary Examiner*—Eric Hug

(74) *Attorney, Agent, or Firm*—Peter T. Nguyen; Stephen T. Murphy

(57) ABSTRACT

The present invention relates to an apparatus for producing a deep-nested embossed paper product comprising two embossing cylinders, each cylinder having a plurality of protrusions on its surface. The protrusions on each cylinder are disposed in a non-random pattern where the respective non-random patterns are coordinated to each other. The two embossing cylinders are aligned such that the respective coordinated non-random pattern of protrusions nest together such that the protrusions engage each other to a depth of greater than about 1.016 mm. The protrusions each comprise a top plane and sidewalls, with the top plane and sidewalls meeting at a protrusion corner. The protrusion corners of the protrusions of the embossing cylinders of the apparatus of the present invention have a radius of curvature ranging from about 0.076 mm to about 1.778 mm.

13 Claims, 2 Drawing Sheets

U.S. PATENT DOCUMENTS 3,414,459 A * 12/1968 Wells ..... 428/180
3,556,907 A 1/1971 Nystrand
3,672,950 A 6/1972 Murphy et al.
3,673,060 A 6/1972 Murphy et al.
3,684,603 A 8/1972 Iltis
3,708,366 A 1/1973 Donnelly
3,867,225 A 2/1975 Nystrand
4,135,024 A 1/1979 Callahan
4,320,162 A 3/1982 Schulz
4,325,773 A 4/1982 Schulz
4,326,002 A 4/1982 Schulz
4,610,743 A 9/1986 Salmeen et al.
4,759,967 A 7/1988 Bauernfeind
4,913,911 A 4/1990 Wildt
4,921,034 A 5/1990 Burgess et al.
4,927,588 A 5/1990 Schulz
5,036,758 A 8/1991 Kobayashi et al.
5,158,523 A 10/1992 Houk et al.
5,158,819 A 10/1992 Goodman, Jr. et al.
5,173,351 A 12/1992 Ruppel et al.
5,294,475 A 3/1994 McNeil
5,339,730 A 8/1994 Ruppel et al.
5,356,364 A 10/1994 Veith et al.
5,409,572 A 4/1995 Kershaw et al.
5,436,057 A 7/1995 Schulz
5,468,323 A 11/1995 McNeil
5,490,902 A 2/1996 Schulz
5,503,896 A 4/1996 Veith et al.
5,529,563 A 6/1996 Veith et al.
5,536,506 A 7/1996 Majeed et al.
5,573,830 A 11/1996 Schulz
5,597,639 A 1/1997 Schulz
5,620,776 A 4/1997 Schulz
5,620,779 A 4/1997 Levy et al.
5,743,999 A 4/1998 Kamps et al.
5,779,965 A 7/1998 Beuther et al.
5,837,102 A 11/1998 Graf
5,840,404 A 11/1998 Graff et al.
5,846,636 A 12/1998 Ruppel et al.
5,868,168 A 2/1999 Mott et al.
5,874,156 A 2/1999 Schulz
5,904,812 A 5/1999 Salman et al.
5,913,765 A 6/1999 Burgess et al.
6,077,390 A 6/2000 Salman et al.
6,077,590 A 6/2000 Archer et al.
6,106,928 A 8/2000 Laurent et al.
6,113,723 A 9/2000 McNeil et al.
6,129,815 A 10/2000 Larson et al.
6,129,972 A 10/2000 McNeil et al.
6,165,319 A 12/2000 Heath et al.
6,176,819 B1 1/2001 Boegli et al.
6,299,729 B1 10/2001 Heath et al.
6,302,998 B1 10/2001 Burgess
6,331,228 B1 12/2001 Heath et al.
6,344,111 B1 2/2002 Wilhelm
6,361,308 B2 3/2002 Wendler, Jr.
6,413,614 B1 7/2002 Giesler et al.
6,468,392 B2 10/2002 Oriarian et al.
6,524,683 B1 2/2003 Roussel et al.
6,571,673 B2 6/2003 Piazza
6,602,577 B1 8/2003 Ostendorf et al.
6,649,024 B2 11/2003 Oriarian et al.
6,699,360 B2 3/2004 Heath et al.
6,733,626 B2 5/2004 Ruthven et al.
6,755,928 B1 6/2004 Biagiotti
6,802,937 B2 10/2004 Johnston et al.
6,887,349 B2 5/2005 Ruthven et al.
6,911,573 B2 6/2005 Chen et al.
6,942,755 B2 * 9/2005 Basler et al. ..... 162/117
2003/0008109 A1 1/2003 Basler et al.
2003/0021953 A1 1/2003 Graff
2003/0110961 A1 6/2003 Bredahl et al.
2003/0111169 A1 6/2003 Baggot et al.
2003/0192662 A1 10/2003 Heath et al.
2003/0228444 A1 12/2003 Johnston et al.
2004/0038006 A1 2/2004 Biagiotti
2004/0055694 A1 * 3/2004 Kershaw et al. ..... 156/209
2004/0163783 A1 8/2004 Muller
2004/0166290 A1 8/2004 Sembritzki et al.
2004/0209050 A1 10/2004 Andersson
2004/0231813 A1 11/2004 Basler et al.
2004/0247836 A1 12/2004 Biagiotti
2005/0098281 A1 5/2005 Schulz et al.

FOREIGN PATENT DOCUMENTS

EP 1 321 287 1/2003
EP 1 312 466 A1 5/2003
EP 1 232 854 B1 4/2005
GB 2 377 674 A1 1/2003
WO WO 94/06623 3/1994
WO WO 98/50481 11/1998
WO WO 00/73053 12/2000
WO WO 03/031170 4/2003
WO WO 03/072344 9/2003

* cited by examiner

PROCESS FOR PRODUCING DEEP-NESTED EMBOSSED PAPER PRODUCTS

CROSS REFERENCE TO RELATED APPLICATIONS

This application claims the benefit of U.S. Provisional Application No. 60/573,727 filed May 21, 2004.

FIELD OF THE INVENTION

The present invention relates to an improved process for producing deep-nested embossed paper products, resulting in significantly less deterioration in paper strength through the embossing process. The present invention also relates to the apparatus for producing such products.

BACKGROUND OF THE INVENTION

The embossing of paper products to make those products more absorbent, softer and bulkier, over unembossed products, is well known in the art. Embossing technology has included pin-to-pin embossing where protrusions on the respective embossing rolls are matched such that the tops of the protrusion contact each other through the paper product, thereby compressing the fibrous structure of the product. The technology has also included male-female embossing, or nested embossing, where protrusions of one or both rolls are aligned with either a non-protrusion area or a female recession in the other roll. U.S. Pat. No. 4,921,034, issued to Burgess et al. on May 1, 1990 provides additional background on embossing technologies.

Deep-nested embossing of multiply tissue products is taught in U.S. Pat. No. 5,686,168 issued to Laurent et al. on Nov. 11, 1997; U.S. Pat. No. 5,294,475 issued to McNeil on Mar. 15, 1994; U.S. patent application Ser. No. 11/059,986; and U.S. patent application Ser. No. 10/700,131. While these technologies have been useful in improving glue bonding of multiply tissues and in providing new aesthetic images on paper products, manufacturers have observed that when producing certain deep nested embossed patterns the resulting paper loses a significant amount of its strength through the embossing process. As expected, paper products having this lower strength detract from the acceptance of the product despite the improved aesthetic impression of the deep nested embossing.

It has been found that a new embossing apparatus comprising rounded embossing protrusions can provide a deep-nested embossed paper product which maintains more of its initial strength after going through the embossing process.

SUMMARY OF THE INVENTION

The present invention relates to an apparatus for producing a deep-nested embossed paper product comprising two embossing cylinders each rotatable on an axis, the axes being parallel to one another. Each cylinder has a plurality of protrusions, or embossing knobs, on its surface. The plurality of protrusions on each cylinder being disposed in a non-random pattern where the respective non-random patterns are coordinated to each other. The two embossing cylinders are aligned such that the respective coordinated non-random pattern of protrusions nest together such that the protrusions engage each other to a depth of greater than about 1.016 mm. The protrusions each comprise a top plane and sidewalls, with the top plane and sidewalls meeting at a protrusion corner. The protrusion corners of the protrusions of the embossing cylinders of the apparatus of the present invention have a radius of curvature ranging from about 0.076 mm to about 1.778 mm.

The present invention also relates to a process for producing a deep-nested embossed paper products comprising the steps of a) producing one or more plies of paper having an unembossed wet burst strength, and b) embossing one or more plies of the paper where the resulting embossed ply or plies of paper comprise a plurality of embossments having an average embossment height of at least about 650 μm and have a finished product wet burst strength of greater than about 85% of the unembossed wet strength.

DETAILED DESCRIPTION OF THE INVENTION

Figure 1:
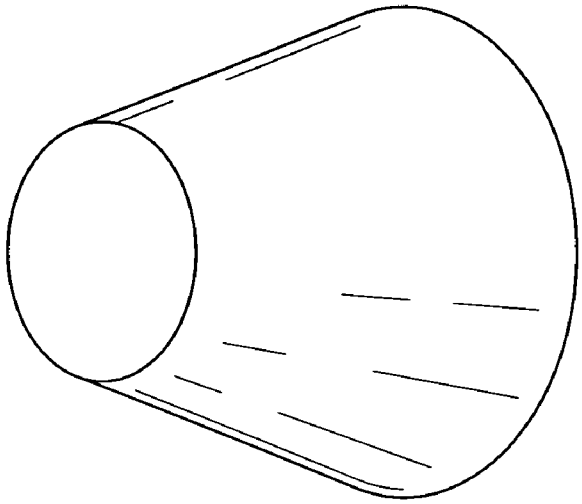
FIG. 1 is a perspective view of a prior art embossing protrusion or knob for use on the surface of the embossing cylinders of a typical embossing apparatus.
Figure 2:
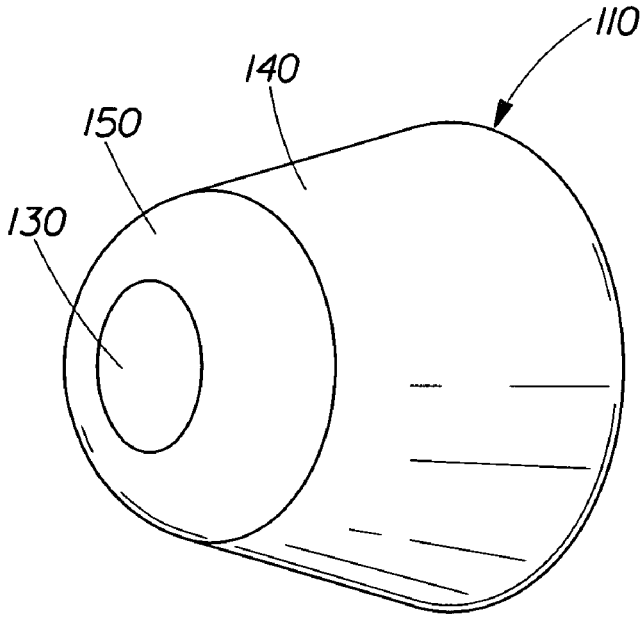
FIG. 2 is a perspective view of the embossing protrusion used on the surface of the embossing cylinder of the apparatus of the present invention.

The present invention relates to an apparatus for producing a deep-nested embossed paper product 20 comprising two embossing cylinders 100 and 200 each rotatable on an axis, the axes being parallel to one another. Each cylinder has a plurality of protrusions 110 and 210, or embossing knobs, on its surface. The plurality of protrusions on each cylinder are disposed in a non-random pattern where the respective non-random patterns are coordinated with each other. The two embossing cylinders 100 and 200 are aligned such that the respective coordinated non-random pattern of protrusions 110 and 210 nest together such that the protrusions engage each other. The protrusions each comprise a top plane 130 and 230 and sidewalls 140 and 240, with the top plane and sidewalls meeting at a protrusion corner 150 and 250. The protrusion corners of the protrusions of the embossing cylinders of the apparatus of the present invention have a radius of curvature r.

Figure 3:
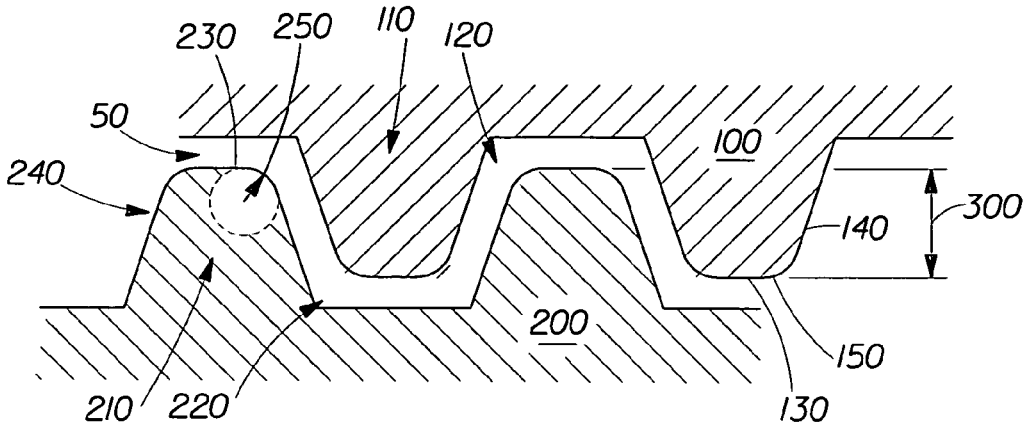
FIG. 3 is a side view of the gap between two engaged emboss cylinders of the apparatus for deep-nested embossing of the present invention.

The present apparatus can be used to emboss one or more plies of paper, thereby imparting a third, depth dimension to the previously essentially flat paper. The apparatus may be based on any embossing equipment known in the industry. The apparatus is particularly advantageous in producing deep-nested embossed products. As depicted in FIG. 3, by "deep-nested embossing" it is meant that the embossing process utilizes paired emboss rolls, or cylinders, 100 and 200 where the respective protrusions 110 and 210 are coordinatedly matched such that the protrusions of one roll fit into some of the space between the protrusions of the other roll 120 and 220.

The apparatus may be contained within a typical embossing device housing and may comprise two embossing cylinders 100 and 200, each rotatable around its axis. The cylinders are typically disposed in the apparatus with their axes parallel to each other. Each cylinder has an outer surface comprising a plurality of protrusions 110 and 210, also known as emboss knobs, arranged in a non-random pattern. The surface, including the protrusions, may be made out of any material typically used for embossing rolls. Such materials include, without limitation, steel, ebonite, and hard rubber. The non-random protrusion patterns on the first and second cylinders are coordinated such that the protrusions deep-nest as described above. The protrusions comprise a top plane 130 and 230 and sidewalls 140 and 240, with the top plane and sidewalls meeting at a protrusion corner 150 and 250. The knobs may have any cross-sectional shape, but circular or elliptical shapes are most typical for use in embossing paper.

The deep-nested emboss process requires that the protrusions of the two emboss cylinders engage such that the top surface 130 of one cylinder extends into the space 220 between the protrusions 210 of the other cylinder beyond the tops 230 of the protrusions. The depth of the engagement 300 may vary depending on the level of embossing desired on the final paper product. Typical embodiments have a depth 300 greater than about 1.016 mm, greater than about 1.270 mm, greater than about 1.524 mm, or greater than about 2.032 mm. The paper to be embossed is passed through the nip 50 formed between the engaged cylinders.

The corners of the protrusions 150 and 250, between the top plane and the sidewall, of the present invention are rounded and have a radius of curvature r. The radius of curvature r is typically greater than about 0.076 mm. Other embodiments have radii of curvatures greater than 0.127 mm, greater than 0.254 mm, or greater than about 0.508 mm. The radius of curvature r of the protrusion corners is less than about 1.778 mm. Other embodiment have radii of curvatures less than about 1.524 mm or less than about 1.016 mm.

The "rounding" of the edge of the corner typically results in a circular arc rounded corner, from which a radius of curvature is easily determined as a traditional radius of the arc. The present invention, however, also contemplates corner configurations which approximate an arc rounding by having the edge of the corner removed by one or more straight line or irregular cut lines. The radius of curvature is determined by determining a best fit circular arc through the protrusion corner.

The apparatus may act on any fibrous structure which would be considered to result in a paper product. Typical fibrous structures are structures which can be used as tissue-towel paper products. As used herein, the phrase "tissue-towel paper product" refers to products comprising paper tissue or paper towel technology in general, including but not limited to conventionally felt-pressed or conventional wet pressed tissue paper; pattern densified tissue paper; and high-bulk, uncompacted tissue paper. Non-limiting examples of tissue-towel paper products include toweling, facial tissue, bath tissue, and table napkins and the like.

The term "ply" as used herein means an individual sheet of fibrous structure having the use as a tissue product. As used herein, the ply may comprise one or more wet-laid layers. When more than one wet-laid layer is used, it is not necessary that they are made from the same fibrous structure. Further, the layers may or may not be homogeneous within the layer. The actual make up of the tissue paper ply is determined by the desired benefits of the final tissue-towel paper product.

The term "fibrous structure" as used herein means an arrangement or fibers produced in any typical papermaking machine known in the art to create the ply of tissue-towel paper. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 disclose layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

The tissue-towel paper product substrate may comprise any tissue-towel paper product known in the industry. Embodiment of these substrates may be made according U.S. Patents: U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995.

The tissue-towel substrates may be through-air-dried or conventionally dried. Optionally, the substrate may be foreshortened by creping or by wet microcontraction. Creping and/or wet microcontraction are disclosed in commonly assigned U.S. Patents: U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

Conventionally pressed tissue paper and methods for making such paper are known in the art. See commonly assigned U.S. Pat. No. 6,547,928 issued to Barnholtz et al. on Apr. 15, 2003. One suitable tissue paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified tissue webs are disclosed in U.S. Pat. No. 3,301,746, issued to Sanford, et al. on Jan. 31, 1967; U.S. Pat. No. 3,974,025, issued to Ayers on Aug. 10, 1976; U.S. Pat. No. 4,191,609, issued to on Mar. 4, 1980; and U.S. Pat. No. 4,637,859, issued to on Jan. 20, 1987; U.S. Pat. No. 3,301,746, issued to Sanford, et al. on Jan. 31, 1967; U.S. Pat. No. 3,821,068, issued to Salvucci, Jr. et al. on May 21, 1974; U.S. Pat. No. 3,974,025, issued to Ayers on Aug. 10, 1976; U.S. Pat. No. 3,573,164, issued to Friedberg, et al. on Mar. 30, 1971; U.S. Pat. No. 3,473,576, issued to Amneus on Oct. 21, 1969; U.S. Pat. No. 4,239,065, issued to Trokhan on Dec. 16, 1980; and U.S. Pat. No. 4,528,239, issued to Trokhan on Jul. 9, 1985.

Uncompacted, non pattern-densified tissue paper structures are also contemplated within the scope of the present invention and are described in U.S. Pat. No. 3,812,000 issued to Joseph L. Salvucci, Jr. et al. on May 21, 1974; and U.S. Pat. No. 4,208,459, issued to Henry E. Becker, et al. on Jun. 17, 1980. Uncreped tissue paper as defined in the art are also contemplated. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 issued Aug. 12, 1997.

Other materials can be added to the aqueous papermaking furnish or the embryonic web to impart other desirable characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993.

If permanent wet strength is desired, cationic wet strength resins can be added to the papermaking furnish or to the embryonic web. Suitable types of such resins are described in U.S. Pat. No. 3,700,623, issued on Oct. 24, 1972, and U.S. Pat. No. 3,772,076, issued on Nov. 13, 1973, both to Keim.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

In addition, other chemical softening agents may be used. Suitable chemical softening agents comprise quaternary ammonium compounds including, but not limited to, the well-known dialkyldimethylammonium salts (e.g., ditallowdimethylammonium chloride, ditallowdimethylammonium methyl sulfate, di(hydrogenated tallow)dimethyl ammonium chloride, etc.). Certain variants of these softening agents include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate. Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997 discloses filled tissue-towel paper products that are acceptable as substrates for the present invention.

The above listings of optional chemical additives is intended to be merely exemplary in nature, and are not meant to limit the scope of the invention.

Another class of substrate suitable for use in the process of the present invention is non-woven webs comprising synthetic fibers. Examples of such substrates include but are not limited to textiles (e.g.; woven and non woven fabrics and the like), other non-woven substrates, and paperlike products comprising synthetic or multicomponent fibers. Representative examples of other preferred substrates can be found in U.S. Pat. No. 4,629,643 issued to Curro et al. on Dec. 16, 1986; U.S. Pat. No. 4,609,518 issued to Curro et al. on Sep. 2, 1986; European Patent Application EP A 112 654 filed in the name of Haq; copending U.S. patent application Ser. No. 10/360,038 filed on Feb. 6, 2003 in the name of Trokhan et al.; copending U.S. patent application Ser. No. 10/360,021 filed on Feb. 6, 2003 in the name of Trokhan et al.; copending U.S. patent application Ser. No. 10/192,372 filed in the name of Zink et al. on Jul. 10, 2002; and copending U.S. patent application Ser. No. 10/149,878 filed in the name of Curro et al. on Dec. 20, 2000.

The present invention also relates to a process for producing a deep-nested embossed paper products comprising the steps of a) producing one or more plies of paper having an unembossed wet burst strength, and b) embossing one or more plies of the paper where the resulting embossed ply or plies of paper comprise a plurality of embossments having an average embossment height of at least about 650 μm and have a finished product wet burst strength of greater than about 85% of the unembossed wet strength.

The ply or plies of paper produced to be the substrate of the deep-nested embossed paper product may be any type of fibrous structures described above, such as, for example, the paper is a tissue-towel product. The unembossed wet burst strength of the incoming plies are measured using the Wet Burst Strength Test Method described below. When more than one plies of paper are embossed the Wet Burst Strength is measured on a sample taken on samples of the individual plies placed together, face to face without glue, into the tester.

The embossing step of the claimed process of the present invention may be performed using any deep nested embossing process. The resulting embossed paper can have embossments having an average embossment height of at least about 650 μm. Other embodiment may have embossment having embossment heights greater than 1000 μm, greater than about 1250 μm, or greater than about 1400 μm. The average embossment height is measured by the Embossment Height Test Method using a GFM Primos Optical Profiler as described in the Test Method section below.

Again the wet burst strength of the finished embossed product is measured by the Wet Burst Strength Test Method below. The product made by the process of the present invention can have a wet burst strength of greater than about 85% of the unembossed wet strength, greater than 90%, or greater than about 92%.

Figure 4:
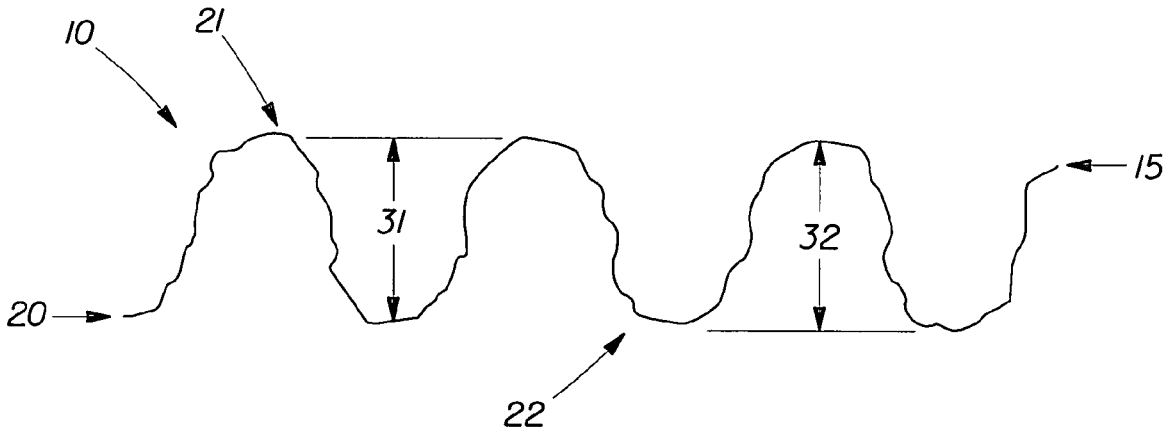
FIG. 4 is a side view of an embodiment of the embossed tissue-towel paper product produced by the apparatus or process of the present invention.

One example of an embossed paper product is shown in FIG. 4. The embossed paper product 10 comprises one or more plies of tissue structure 15, wherein at least one of the plies comprises a plurality of embossments 20. The ply or plies which are embossed are embossed in a deep nested embossing process such that the embossments exhibits an embossment height 31 of at least about 650 μm, at least 1000 μm, at least about 1250 μm, or at least about 1400 μm. The embossment height 31 of the tissue-towel paper product is measured by the Embossment Height Test method.

EXAMPLES

Example 1

One fibrous structure useful in achieving the embossed tissue-towel paper product is the through-air dried (TAD), differential density structure described in U.S. Pat. No. 4,528,239. Such a structure may be formed by the following process.

A pilot scale Fourdrinier, through-air-dried papermaking machine is used in the practice of this invention. A slurry of papermaking fibers is pumped to the headbox at a consistency of about 0.15%. The slurry consists of about 65% Northern Softwood Kraft fibers and about 35% unrefined Southern Softwood Kraft fibers. The fiber slurry contains a cationic polyamine-epichlorohydrin wet strength resin at a concentration of about 12.5 kg per metric ton of dry fiber, and carboxymethyl cellulose at a concentration of about 3.25 kg per metric ton of dry fiber.

Dewatering occurs through the Fourdrinier wire and is assisted by vacuum boxes. The wire is of a configuration having 33.1 machine direction and 30.7 cross direction filaments per cm, such as that available from Albany International known at 84×78-M.

The embryonic wet web is transferred from the Fourdrinier wire at a fiber consistency of about 22% at the point of transfer, to a TAD carrier fabric. The wire speed is about 195 meters per minute. The carrier fabric speed is about 183 meters per minute. Since the wire speed is about 6% faster than the carrier fabric, shortening of the web occurs at the transfer point. Thus, the wet web foreshortening is 6%. The sheet side of the carrier fabric consists of a continuous, patterned network of photopolymer resin, said pattern containing about 130 deflection conduits per cm. The deflection conduits are arranged in a bi-axially staggered configuration, and the polymer network covers about 25% of the surface area of the carrier fabric. The polymer resin is supported by and attached to a woven support member consisting of 27.6 machine direction and 13.8 cross direction filaments per cm. The photopolymer network rises about 0.203 mm above the support member.

The consistency of the web is about 65% after the action of the TAD dryers operating about a 232° C., before transfer onto the Yankee dryer. An aqueous solution of creping adhesive consisting of polyvinyl alcohol is applied to the Yankee surface by spray applicators at a rate of about 2.5 kg per metric ton of production. The Yankee dryer is operated at a speed of about 183 meters per minute. The fiber consistency is increased to an estimated 99% before creping the web with a doctor blade. The doctor blade has a bevel angle of about 25 degrees and is positioned with respect to the Yankee dryer to provide an impact angle of about 81 degrees. The Yankee dryer is operated at about 157° C., and Yankee hoods are operated at about 177° C.

The dry, creped web is passed between two calendar rolls and rolled on a reel operated at 165 meters per minute, so that there is about 16% foreshortening of the web by crepe; 6% wet microcontraction and an additional 10% dry crepe. The resulting paper has a basis weight of about 24 grams per square meter (gsm).

The paper described above is then subjected to the deep embossing process of this invention. Two emboss cylinders are engraved with complimentary, nesting protrusions shown in FIG. 3. The cylinders are mounted in the apparatus with their respective axes being parallel to one another. The protrusions are frustaconical in shape, with a face (top or distal—i.e. away from the roll from which they protrude) diameter of about 1.52 mm and a floor (bottom or proximal—i.e. closest to the surface of the roll from which they protrude) diameter of about 0.48 mm. The height of the protrusions on each roll is about 3.05 mm. The radius of curvature is about 0.76 mm. The engagement of the nested rolls is set to about 2.49 mm, and the paper described above is fed through the engaged gap at a speed of about 36.6 meters per minute. The resulting paper has an embossment height of greater than 650 μm, a finished product wet burst strength greater than about 85% of its unembossed wet strength.

Example 2

In another preferred embodiment of the embossed tissue-towel paper products, two separate paper plies are made from the paper making process of Embodiment 1. The two plies are then combined and embossed together by the deep nested embossing process of Embodiment 1. The resulting paper has an embossment height of greater than 650 μm, a finished product wet burst strength greater than about 85% of its unembossed wet strength.

Example 3

In another preferred embodiment of the embossed tissue-towel paper products, three separate paper plies are made from the paper making process of Embodiment 1. Two of the plies are deep nested embossed by the deep nested embossing process of the Embodiment 1. The three plies of tissue paper are then combined in a standard converting process such that the two embossed plies are the respective outer plies and the unembossed ply in the inner ply of the product. The resulting paper has an embossment height of greater than 650 μm, a finished product wet burst strength greater than about 85% of its unembossed wet strength.

Example 4

In a preferred example of a through-air dried, differential density structure described in U.S. Pat. No. 4,528,239 may be formed by the following process.

The TAD carrier fabric of Example 1 is replaced with a carrier fabric consisting of 88.6 bi-axially staggered deflection conduits per cm, and a resin height of about 0.305 mm. This paper is further subjected to the embossing process of Example 1, and the resulting paper has an embossment height of greater than 650 μm, a finished product wet burst strength greater than about 85% of its unembossed wet strength.

Example 5

An alternative embodiment of the present fibrous structure is a paper structure having a wet microcontraction greater than about 5% in combination with any known through air dried process. Wet microcontraction is described in U.S. Pat. No. 4,440,597. An example of embodiment 5 may be produced by the following process.

The wire speed is increased to about 203 meters per minute. The carrier fabric speed is about 183 meters per minute. The wire speed is 10% faster compared to the TAD carrier fabric so that the wet web foreshortening is 10%. The TAD carrier fabric of Example 1 is replaced by a carrier fabric having a 5-shed weave, 14.2 machine direction filaments and 12.6 cross-direction filaments per cm. The Yankee speed is about 183 meters per minute and the reel speed is about 165 meters per minute. The web is foreshortened 10% by wet microcontraction and an additional 10% by dry crepe. The resulting paper prior to embossing has a basis weight of about 33 gsm. This paper is further subjected to the embossing process of Example 1, and the resulting paper has an embossment height of greater than 650 μm, a finished product wet burst strength greater than about 85% of its unembossed wet strength.

Example 6

Another embodiment of the fibrous structure of the present invention is the through air dried paper structures having machine direction impression knuckles as described in U.S. Pat. No. 5,672,248. A commercially available single-ply substrate made according to U.S. Pat. No. 5,672,248 having a basis weight of about 38 gsm sold under the Trade-name Scott and manufactured by Kimberly Clark Corporation, is subjected to the embossing process of Example 1. The resulting paper has an embossment height of greater than 650 μm, a finished product wet burst strength greater than about 85% of its unembossed wet strength.

Test Methods

Embossment Height Test Method

Embossment height is measured using a GFM Primos Optical Profiler instrument commercially available from GFMesstechnik GmbH, Warthestraβe 21, D14513 Teltow/Berlin, Germany. The GFM Primos Optical Profiler instrument includes a compact optical measuring sensor based on the digital micro mirror projection, consisting of the following main components: a) DMD projector with 1024×768 direct digital controlled micro mirrors, b) CCD camera with high resolution (1300×1000 pixels), c) projection optics adapted to a measuring area of at least 27×22 mm, and d) recording optics adapted to a measuring area of at least 27×22 mm; a table tripod based on a small hard stone plate; a cold light source; a measuring, control, and evaluation computer; measuring, control, and evaluation software ODSCAD 4.0, English version; and adjusting probes for lateral (x-y) and vertical (z) calibration.

The GFM Primos Optical Profiler system measures the surface height of a sample using the digital micro-mirror pattern projection technique. The result of the analysis is a map of surface height (z) vs. xy displacement. The system has a field of view of 27×22 mm with a resolution of 21 microns. The height resolution should be set to between 0.10 and 1.00 micron. The height range is 64,000 times the resolution.

To measure a fibrous structure sample do the following:

1. Turn on the cold light source. The settings on the cold light source should be 4 and C, which should give a reading of 3000K on the display;

2. Turn on the computer, monitor and printer and open the ODSCAD 4.0 Primos Software.

3. Select "Start Measurement" icon from the Primos taskbar and then click the "Live Pic" button.

4. Place a 30 mm by 30 mm sample of fibrous structure product conditioned at a temperature of 73° F.±2° F. (about 23° C.±1° C.) and a relative humidity of 50% ±2% under the projection head and adjust the distance for best focus.

5. Click the "Pattern" button repeatedly to project one of several focusing patterns to aid in achieving the best focus (the software cross hair should align with the projected cross hair when optimal focus is achieved). Position the projection head to be normal to the sample surface.

6. Adjust image brightness by changing the aperture on the lens through the hole in the side of the projector head and/or altering the camera "gain" setting on the screen. Do not set the gain higher than 7 to control the amount of electronic noise. When the illumination is optimum, the red circle at bottom of the screen labeled "I.O." will turn green.

7. Select Technical Surface/Rough measurement type.

8. Click on the "Measure" button. This will freeze on the live image on the screen and, simultaneously, the image will be captured and digitized. It is important to keep the sample still during this time to avoid blurring of the captured image. The image will be captured in approximately 20 seconds.

9. Save the image to a computer file with ".omc" extension. This will also save the camera image file ".kam".

10. To move the date into the analysis portion of the software, click on the clipboard/man icon.

11. Now, click on the icon "Draw Cutting Lines". Make sure active line is set to line 1. Move the cross hairs to the lowest point on the left side of the computer screen image and click the mouse. Then move the cross hairs to the lowest point on the right side of the computer screen image on the current line and click the mouse. Now click on "Align" by marked points icon. Now click the mouse on the lowest point on this line, and then click the mouse on the highest point on this line. Click the "Vertical" distance icon. Record the distance measurement. Now increase the active line to the next line, and repeat the previous steps, do this until all lines have been measured, six (6) lines in total. Take the average of all recorded numbers, and if the units are not micrometers, convert them to micrometers (μm). This number is the embossment height for this replicate. Repeat this procedure three more times (for a total of four replicates). Take the average of the four replicates to get the embossment height for the sample.

Wet Burst Strength Method

"Wet Burst Strength" as used herein is a measure of the ability of a fibrous structure and/or a paper product incorporating a fibrous structure to absorb energy, when wet and subjected to deformation normal to the plane of the fibrous structure and/or paper product. Wet burst strength may be measured using a Thwing-Albert Burst Tester Cat. No. 177 equipped with a 2000 g load cell commercially available from Thwing-Albert Instrument Company, Philadelphia, Pa.

For 1-ply and 2-ply products having a sheet length (MD) of approximately 11 inches (280 mm) remove two usable units from the roll. Carefully separate the usable units a the perforations and stack them on top of each other. Cut the usable units in half in the Machine Direction to make a sample stack of four usable units thick. For usable units smaller than 11 inches (280 mm) carefully remove two strips of three usable units from the roll. Stack the strips so that the perforations and edges are coincident. Carefully remove equal portions of each of the end usable units by cutting in the cross direction so that the total length of the center unit plus the remaining portions of the two end usable units is approximately 11 inches (280 mm). Cut the sample stack in half in the machine direction to make a sample stack four usable units thick.

The samples are next oven aged. Carefully attach a small paper clip or clamp at the center of one of the narrow edges. "Fan" the other end of the sample stack to separate the towels which allows circulation of air between them. Suspend each sample stack by a clamp in a 221° F.±2° F. (105° C.±1° C.) forced draft oven for five minutes±10 seconds. After the heating period, remove the sample stack from the oven and cool for a minimum of 3 minutes before testing.

Take one sample strip, holding the sample by the narrow cross machine direction edges, dipping the center of the sample into a pan filled with about 25 mm of distilled water. Leave the sample in the water four (4) (±0.5) seconds. Remove and drain for three (3) (±0.5) seconds holding the sample so the water runs off in the cross machine direction. Proceed with the test immediately after the drain step. Place the wet sample on the lower ring of a sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest g.

What is claimed is:

1. An apparatus for producing a deep-nested embossed paper product comprising:

two embossing cylinders each rotatable on an axis, the axes being parallel to one another;

each cylinder having a surface and a plurality of protrusions on its surface, the plurality of protrusions on each cylinder being disposed in a non-random pattern where the respective non-random patterns are coordinated to each other;

the two embossing cylinders aligned such that the respective coordinated non-random pattern of protrusions nest together such that the protrusions engage each other to a depth of greater than about 1.016 mm;

where the protrusions comprise a top plane and sidewalls, the top plane and sidewalls meeting at a protrusion corner and the protrusion corner having a radius of curvature greater than about 0.076 mm and less than about 1.778 mm.

2. An apparatus for producing a deep-nested embossed paper product according to claim 1, wherein the protrusions engage each other to a depth of greater than 1.524 mm and the radius of curvature of the protrusion corner is greater than about 0.508 mm and less than about 1.0 16 mm.

3. A process for producing a deep-nested embossed paper product comprising the steps of:

a) delivering one or more plies of paper to an embossing apparatus; and b) embossing the one or more plies of the paper through a nip between two embossing cylinders, each cylinder having a plurality of protrusions disposed in a non-random pattern, where the respective non-random patterns are coordinated to each other, wherein the two embossing cylinders are aligned such that the respective coordinated non-random pattern of protrusions nest together such that the protrusions engage each other to a depth of greater than about 1.016 mm, and where the protrusions comprise a top plane and sidewalls, the top plane and sidewalls meeting at a protrusion corner and the protrusion corner having a radius of curvature ranging from about 0.076 mm to about 1.778 mm.

4. A process for producing a deep nested embossed paper product comprising the step of:

a) delivering one or more plies of paper to an embossing apparatus; and b) embossing the one or more plies of the paper;

wherein the resulting embossed ply or plies of paper comprises a plurality of embossments having an average embossment height of at least about 650 μm and have a finished product wet burst strength of greater than about 85% of the unembossed wet strength.

5. A process according to claim 4 where the paper produced and embossed is a tissue-towel paper.

6. A process according to claim 5 where the resulting embossed paper has an average embossment height of at least about 1000 μm.

7. A process according to claim 6 where the resulting embossed paper has an average embossment height of at least about 1250 μm.

8. A process according to claim 7 where the resulting embossed paper has an average embossment height of at least about 1400 μm.

9. A process according to claim 5 where the paper delivered to the embossing apparatus and embossed is a tissue-towel paper substrate.

10. A process according to claim 9 where two plies of tissue-towel paper substrate are delivered to the apparatus and embossed.

11. A paper product having a plurality of embossments having an average embossment height of greater than about 650 μm and having an unembossed wet burst strength and a finished product wet burst strength of greater than about 85 % of the unembossed strength.

12. A paper product according to claim 11, wherein the paper plies are plies of tissue-towel paper product.

13. A paper product according to claim 12 where the plurality of embossments have an average embossment height of greater than about 1000μm and a finished product wet burst strength of greater than about 90 % of the unembossed strength.

* * * * *